United States Patent [19]

Cook

[11] 4,274,454

[45] Jun. 23, 1981

[54] METHOD AND APPARATUS FOR SEALING CONTAINERS

[75] Inventor: John P. Cook, Chattanooga, Tenn.

[73] Assignee: Electric Power Research Institute, Inc., Palo Alto, Calif.

[21] Appl. No.: 14,860

[22] Filed: Feb. 26, 1979

[51] Int. Cl.[3] ..... B65B 5/00

[52] U.S. Cl. ..... 141/1; 53/86; 137/614; 141/311 R; 141/383; 220/20.5; 220/345

[58] Field of Search ..... 53/86, 90; 137/614; 141/1, 97, 113, 281, 363, 311 R, 383–386, 392, 346; 220/20.5, 345

[56] References Cited

U.S. PATENT DOCUMENTS 3,513,887 5/1970 Limandri ..... 141/346 X

*Primary Examiner*—Frederick R. Schmidt

*Attorney, Agent, or Firm*—Flehr, Hohbach, Test

[57] ABSTRACT

Method and apparatus for sealing containers. The apparatus includes a slideable carrier closure member in the form of a plate and a closure member that is retained in a recess in the face of the carrier closure member. The two closure members are guided between an open position and a closed position. In the open position the carrier closure member is removed to one side of the opening of a first container and in the closed position the closure member is aligned for sealing the container. The apparatus permits two containers to be joined together, equipment inside one container to be transferred to the other container and the containers to be thereafter separated while continuously maintaining the containers and the equipment sealed from the atmosphere.

10 Claims, 8 Drawing Figures

METHOD AND APPARATUS FOR SEALING CONTAINERS

This invention generally relates to containers, and more particularly, to devices for sealing such containers.

It is frequently desirable to bring two containers together, transfer equipment from one container to the other and thereafter separate the containers while continuously sealing both of the containers from the atmosphere and while preventing the materials in the containers from escaping.

In the past this transfer process was performed using two gate valves, one attached to each of the containers. To join the containers together, the two gate valves, in the closed position, are brought together and bolted to a common coupling. Next, the discs in the gate valves are opened so that a clear passage is formed from one container to the other. The equipment is then transferred from one container to the other through the gate valve bodies and the coupling. The two gate valves are then closed to individually seal the containers and each container is thereafter removed from the coupling.

The concept of using two gate valves and a common coupling has worked well in many applications. However, recently a need has arisen for a closure that will perform these functions and yet will permit the containers to move through small access hatches and into narrow locations. What is needed is a closure that will not extend beyond the diameter of the container. The gate valve system described above is unusable in this application because it requires an extended valve body on each valve to house the gate valve disc when it is in the open position. These extended valve bodies are too large to pass through a small access hatch.

It is an objective of the present invention to seal two containers with a single device and to permit the containers to be separated one from the other while maintaining each in a sealed condition. This objective is achieved by an apparatus having a carrier closure member and a closure member retained in a recessed face of the carrier closure member. The two members are adapted to seal the two containers and to permit their separation.

An additional objective of the present invention is to provide a closure that does not extend beyond the periphery of one of the containers being sealed. This objective is achieved by a removable closure member that is attachable to a flange on the container.

These and other objectives and adavantages are achieved by an apparatus for sealing containers comprising a slideable carrier closure member in the form of a plate. The carrier closure member is housed within a carrier closure guide means for permitting the carrier closure member to move between an open position and a closed position. In the open position the carrier closure member is displaced from the opening of the first container and in the closed position the carrier closure member is aligned for sealing the container. The apparatus further includes a closure member that is retained in a recess in the face of the carrier closure member. The closure member is adapted for being brought into sealing engagement with the container so that the two closure members can each seal one of the containers.

Additional objectives and features of the invention will appear from the following description in which the preferred embodiment has been set forth in detail in conjunction with the accompanying drawings.

Figure 1:
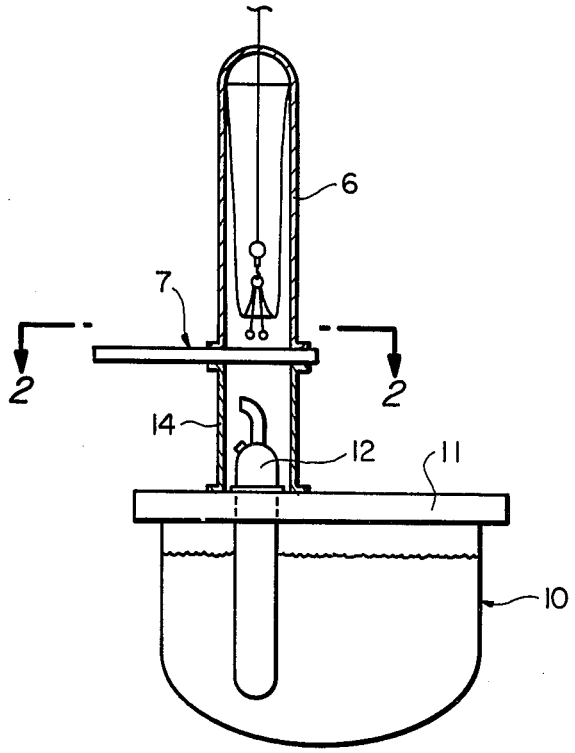
FIG. 1 is a diagrammatic, side elevational view of an apparatus for sealing containers according to the present invention.

FIG. 1 illustrates the preferred embodiment of the present invention as it may be used in connection with the transportation and protection of nuclear reactor components. The apparatus 7 for sealing containers is mounted in FIG. 1 between the bottom of a maintenance container 6 and a coupling 14 which is positioned over a nuclear reactor 10. The maintenance container is used for housing equipment during transit between the reactor and the maintenance area (not shown). The container prevents damage to the equipment, escape of radioactive contamination and exposure of air to the equipment and to the interior of the reactor. The nuclear reactor illustrated in FIG. 1 is a pool-type reactor using a liquid metal coolant. The reactor is covered by a deck 11 which supports an intermediate heat exchanger 12 of conventional construction. The maintenance container 6 and the sealing apparatus 7 are mounted above the intermediate heat exchanger on a cylindrical coupling 14 which positions these two components.

It should be understood that the nuclear reactor 10, FIG. 1, its intermediate heat exchanger 12, the coupling 14, and the maintenance container 6 are of known construction. These components are described herein merely to give an illustrative example of the use of the sealing apparatus 7.

Figure 4:
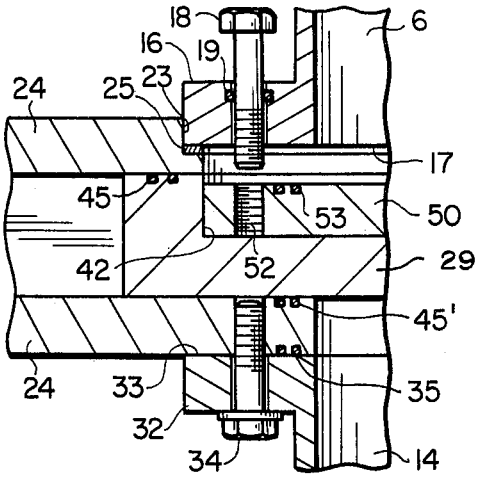
FIG. 4 is a side elevational view partially broken away and in section as indicated by line 4 of FIG. 3 of the apparatus.

Referring to FIG. 4, the open bottom end of the maintenance container 6 is terminated by a flange 16. The bottom of the flange forms a sealing surface 17 which engages the sealing apparatus of the present invention. The flange contains a circle of threaded holes which receive a plurality of bolts 18. These bolts are each sealed by an O-ring 19.

The flange 16, FIG. 4 of the maintenance container 6 is received in a recess 23 in the top of a carrier closure guide means 24. The carrier closure guide means houses a carrier closure member 29 described below and permits this member to move between an open position and a closed position. The flange 16 and the carrier closure guide means 24 are sealed by a gasket 25 which is positioned on the horizontal surface of the recess. The carrier closure guide means includes a pair of pneumatic actuators 26, FIG. 2 that extend and retract the operating arms 27. These operating arms cause the carrier closure member 29 to move relative to the carrier closure guide means 24 which is stationary.

By way of analogy, the carrier closure guide means 24, FIG. 4 can be roughly compared to a valve body for a gate valve. In like manner the carrier closure member, which moves back and forth within the guide means, can be compared to some extent to a gate valve disc.

The cylindrical coupling 14, FIG. 1 rests on the reactor deck 11 and supports both the maintenance container 6 and the sealing apparatus 7 over the intermediate heat exchanger 12 and in co-axial vertical alignment therewith. The cylindrical coupling 14, like the maintenance container 6, terminates in a flange 32, FIG. 4. This flange has a sealing surface 33 that engages the carrier closure guide means 24 described above. These two components are held together by a plurality of bolts 34 and the seal is effected by the O-rings 35.

Figure 2:
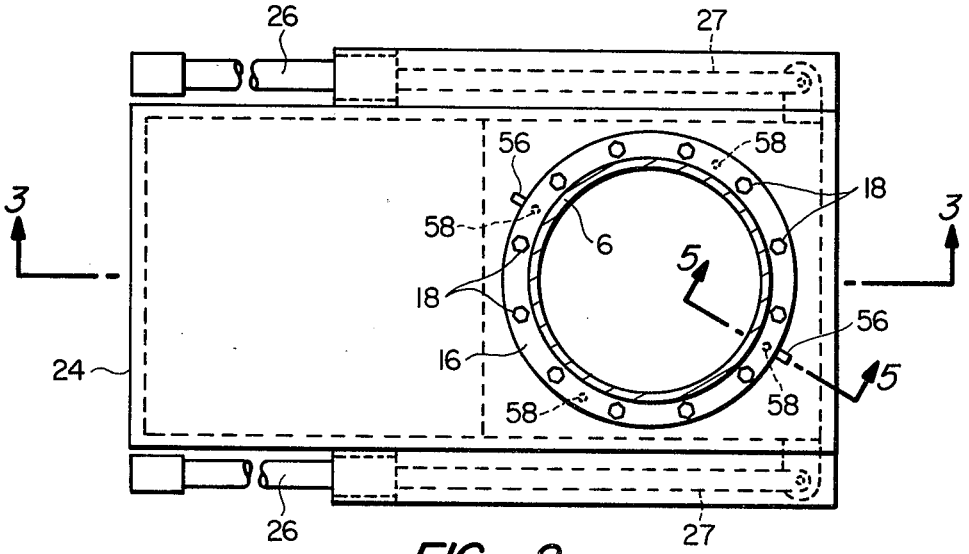
FIG. 2 is a top plan view, in section taken along line 2—2 of FIG. 1, illustrating the apparatus for sealing containers according to the present invention.
Figure 3:
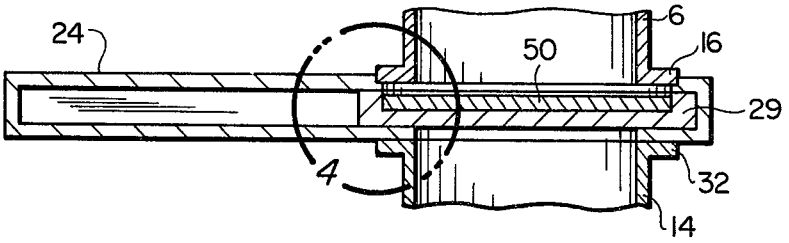
FIG. 3 is a side elevational view partially broken away and in section taken along line 3—3 of FIG. 2 of the apparatus.

The carrier closure member 29, FIGS. 3, and 4 has the form of a flat plate and can slide back and forth within the carrier closure guide means 24 from left to right in a horizontal plane as illustrated in FIG. 3. The carrier closure member 29 is moved from left to right in a horizontal plane as illustrated in FIG. 3. The carrier closure member 29 is moved from left to right by the extension and retraction of the operating arms 27, FIG. 2. The carrier closure member moves with respect to the carrier closure guide means 24 which is stationary and it is sealed within the carrier closure guide means by an upper set of O-rings 45 and a lower set of O-rings 45'. When the carrier closure member is in the open position, it is removed to one side of the openings in the maintenance container 6 and the coupling 14 so that equipment can be brought from the maintenance container to the coupling and vice versa. When the carrier closure member is in the closed position, the carrier closure member covers the openings of the maintenance container and the coupling. FIGS. 2, 3 and 4 illustrate the carrier closure member 29 in the closed position.

The carrier closure member 29, FIGS. 3 and 4 includes a circular recess 42 in its upper horizontal face. This recess is dimensioned to receive a closure member 50 that is adapted to seal the bottom of the maintenance container 6. The closure member has the shape of a flat disc and has a diameter substantially larger than the opening in the bottom of the maintenance container 6. The closure member can be elevated into engagement with the sealing surface 17 on the bottom of the maintenance container 6 using the bolts 18 that engage a circle of holes 52 in the closure member. When the bolts are released, the closure member falls by gravity into the recess 42. The closure member, when elevated, seals the bottom of the maintenance container 6 using the O-rings 53 located in its upper horizontal face.

It should be noted from FIG. 4 that the vertical thickness of the closure member 50 is less than the height of the side wall of the recess 42. This dimensioning permits the carrier closure member 29 to move back and forth from left to right as illustrated in FIG. 4 while carrying the closure member in its recess. It should further be noted that the vertical thickness of the closure member 50 is such that when the closure member is brought up into engagement with the sealing surface 17, the closure member 50 blocks the horizontal motion of the carrier closure member 29. This occurs because the bottom portion of the closure member extends down and engages the side wall of the recess 42 and blocks the carrier closure member 29 in the closed position.

Figure 5:
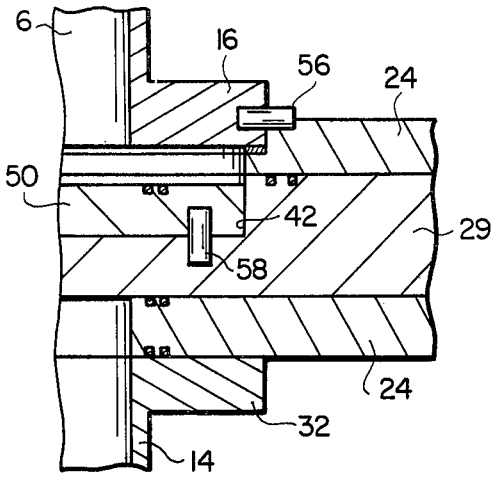
FIG. 5 is a side elevational view partially broken away and in section taken along line 5—5 of FIG. 2 of the apparatus.

Referring to FIGS. 5 and 2, the azimuthal alignment of the maintenance container 6 about the vertical axis with respect to the carrier closure guide means 24 is maintained by a plurality of horizontally disposed pins 56. The pins 56 are rigidly mounted in the vertical side wall of the flange 16, FIG. 5. When the maintenance container 6 is placed on the carrier closure guide means 24, the pins are each received in corresponding grooves in the guide means. Referring to FIGS. 5 and 2, relative motion between the closure member 50 and the carrier closure member 29 is prevented by a plurality of vertically oriented pins 58 that are rigidly mounted in the bottom of the recess 42. When the closure member 50 is lowered into the recess, the pins 58 each engage a corresponding vertical hole in the closure member. The purpose of the horizontal pins 56 and the vertical pins 58 is to ensure that there is no relative motion between the bolt holes 52, FIG. 4 in the closure member and the bolts 18 in the flange of the maintenance container when the bolts are removed.

In operation, the apparatus 7, FIG. 1 for sealing containers permits the maintenance container 6 to be positioned over the intermediate heat exchanger 12 and the heat exchanger to be safely removed from the reactor. This process is performed while keeping the reactor and the heat exchanger completely isolated from the atmosphere so that both the coolant in the reactor and the radioactive contamination associated with the heat exchanger do not endanger personnel and equipment. The apparatus has special application where the primary coolant is a liquid metal such as sodium which can be highly radioactive and which ignites when exposed to oxygen.

The transfer of the intermediate heat exchanger 12, FIG. 1 begins by first installing the cylindrical coupling 14 over the heat exchanger and rigidly securing it to the deck 11 of the reactor. Next referring to FIG. 6, the carrier closure guide means 24 and the carrier closure member 29 are rigidly attached to the coupling by the bolts 34. The carrier closure member 29 is placed in the closed position sealing the coupling 14.

Figure 6:
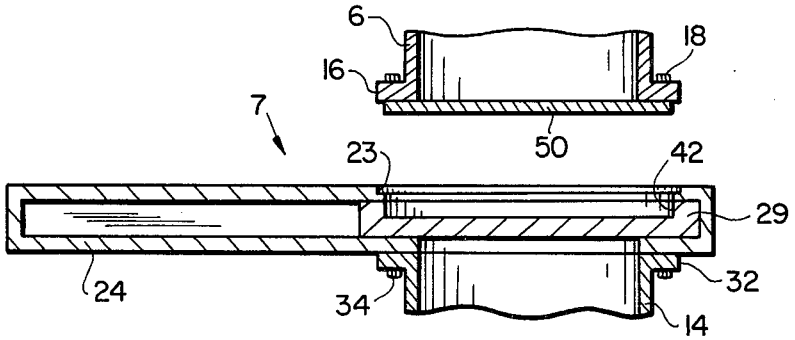
FIGS. 6, 7, 8 are diagrammatic side elevational views partially broken away and in section of the apparatus of FIG. 3 illustrating its operation.

During these preparations the maintenance container 6, FIG. 1 is sealed by the placement of the closure member 50 over its open end as shown in FIG. 6. The maintenance container contains a remotely operated winch that can raise and lower the hook illustrated in FIG. 1.

After the closure member 50 is in place, the maintenance container 6 is evacuated and filled with an inert gas such as argon.

Figure 7:
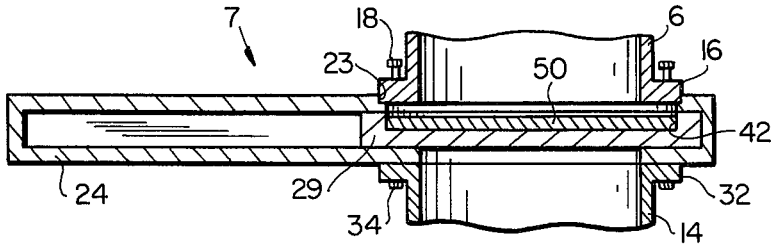

Next, the maintenance container 6, FIG. 7 is positioned in the upper recess 23, of the carrier closure guide means 24. The horizontal pins 56, FIG. 5 are received in the slots corresponding to their position. Thereafter the bolts 18 in the flange 16 of the maintenance container are rotated in a manner to lower the closure member 50 into the recess 42 of the carrier closure member 29. FIG. 7 illustrates the bolts 18 in the withdrawn position and the closure member lowered into the recess of the carrier closure member. This is the closed position wherein communication between the maintenance container 6 and the coupling 14 is blocked.

Figure 8:
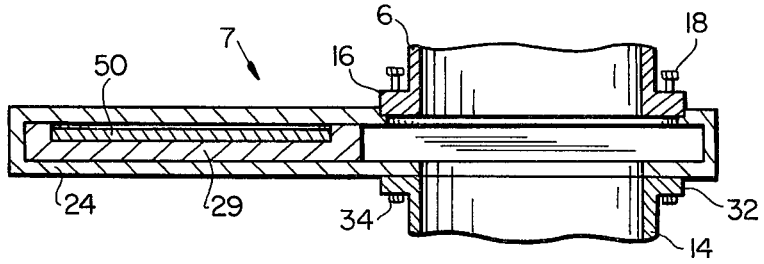

Referring to FIG. 8, the carrier closure member 29 and the closure member 50 are next moved from right to left by the actuation of the pneumatic actuators 26, FIG. 2. The carrier closure member is brought to the open position on one side of the openings of the maintenance container 6 and the coupling 14. Thereafter the hook illustrated in FIG. 1 is lowered to engage the heat exchanger 12 and to lift it up into the maintenance container 6. Once the heat exchanger is in the maintenance container 6, the carrier closure member 29, FIG. 8 is moved from left to right and brought back to the closed position as illustrated in FIG. 7. Thereafter the bolts 18 are brought into engagement with the closure member 50 and the closure member is brought up into sealing engagement with the flange 16 on the bottom of the maintenance container 6. The closure member thus seals the bottom of the maintenance container and prevents both the escape of radioactive comtamination and the exposure of the intermediate heat exchanger to oxygen. The closure member does not extend beyond the periphery of the maintenance container and the container can thus pass through small access hatches and into narrow locations.

The maintenance container is thereafter removed from the sealing apparatus 7 as illustrated in FIG. 6. The coupling 7 and the nuclear reactor 10 are sealed from the atmosphere by the positioning of the carrier closure member 29 over the opening of the coupling. Thus, radioactive contamination is prevented from escaping from the reactor and oxygen is prevented from contacting the sodium coolant in the reactor 10.

Thus although the best mode contemplated for carrying out the present invention has been herein shown and described, it should be apparent that variation and modification may be made without departing from what is considered to be the subject matter of the invention.

What is claimed is:

1. An apparatus for sealing two containers, comprising:

(a) first and second co-axial containers each having planar sealing surfaces that face each other;

(b) a slideable, carrier closure member in the form of a plate;

(c) carrier closure guide means housing the carrier closure member and positioned between the sealing surfaces of the first and second containers, said guide means being adapted for permitting the carrier closure member to slide between a closed position and an open position, in said closed position the carrier closure member blocks the openings of the first and second containers and in said open position the carrier closure member is displaced from the openings of the first and second containers so that said containers are in communication;

(d) a closure member retained in a recess in the face of the carrier closure member;

(e) means for disengagably connecting said closure member with said second container; and (f) sealing means carried on the closure member for establishing a seal between the closure member and the second container when the closure member is engaged with said second container by said connecting means.

2. An apparatus as in claim 1 including sealing means carried on the guide means for engaging the second container so that when the carrier closure member is in the open position, the first container is in communication with the second container.

3. Method for sealing containers so that objects can be transferred from one container to another without exposure to the atmosphere, comprising the steps of:

(a) attaching a carrier closure guide means to a sealing surface on a first container, said first container having a transferrable object therein, said carrier closure guide means housing a carrier closure member in the form of a plate, said carrier closure guide means being adapted for permitting the carrier closure member to slide between a closed position and an open position, said carrier closure member also having a closure member retained in a recess in the face thereof;

(b) bringing a second container into co-axial alignment with said first container and into sealing engagement with the carrier closure guide means, said guide means being positioned between said two containers;

(c) moving the carrier closure member and the closure member to the open position wherein the carrier closure member is displaced from the opening of the first container so that the first and second co-axial containers are in communication through the carrier closure guide means;

(d) transferring the object in the first container to the second container through the carrier closure guide means;

(e) moving the carrier closure member and the closure member to the closed position wherein the carrier closure member is aligned for sealing the opening of the first container;

(f) bringing the closure member into sealing engagement with the second container with the object therein; and (g) separating the second container from the first container with said first container sealed by the carrier closure member and said second container sealed by the closure member.

4. Method for sealing containers so that objects can be transferred from one container to another without exposure to the atmosphere, comprising the steps of:

(a) attaching a carrier closure guide means to a sealing surface on a first container, said first container having a transferrable object therein, said carrier closure guide means housing a carrier closure member in the form of a plate, said carrier closure guide means being adapted for permitting the carrier closure member to slide between a closed position and an open position;

(b) attaching a closure member to a sealing surface on a second container;

(c) bringing the second container into co-axial alignment with said first container and into sealing engagement with the carrier closure guide means, said guide means being positioned between said two containers;

(d) transferring the closure member from the second container to a recess in the face of the carrier closure member;

(e) moving the carrier closure member and the closure member to the open position wherein the carrier closure member is displaced from the container openings so that the first and second containers are in communication through the carrier closure guide means;

(f) transferring the object in the first container to the second container through the carrier closure guide means;

(g) moving the carrier closure member and the closure member to the closed position wherein the carrier closure member is aligned for sealing the containers;

(h) transferring the closure member from the recess in the carrier closure member into sealing engagement with the second container; and (i) separating the second container from the first container with said first container sealed by the carrier closure member and said second container sealed by the closure member.

5. A method according to claim 4 including the step of evacuating the interior of said second container after said closure member is attached thereto and filling said second chamber with inert gas.

6. An apparatus for disengagably connecting together first and second containers at respective open ends of the latter when said opened ends are brought into a predetermined confronting relationship with one another, said apparatus comprising:

(a) a plate-shaped main closure member having first and second opposite sides larger than each of said open ends whereby to span entirely across and close each of said open ends, said main closure member including a recess in its first side, said recess being at least larger than the opened end of said second container;

(b) means supporting said plate-shaped main closure member for movement between a first position directly between the opened ends of said containers for closing said open ends and any access between the containers and a second position laterally to one side of said opened ends for providing access between the containers, said main closure member being supported by said support means such that its recess faces toward said second container;

(c) a plate-shaped secondary closure member sufficiently large to close the opened end of said second container if engaged with the latter in a predetermined way and sufficiently small to fit within the recess in said main closure member and be movable along with the latter between said first and second positions;

(d) means for disengagably connecting said secondary closure member to said second container in said predetermined way; and (e) means for establishing a seal around the opened ends of the containers when said open ends are in said confronting relationship and said main and secondary closure members are in said second position.

7. An apparatus according to claim 6 where the said support means includes a guide arrangement disengagably connected with said first container, said arrangement including a section located laterally to one side of the opened end of said first container for receiving said closure member in its second position and means for guiding said main closure member between its first and second positions.

8. An apparatus according to claim 7 wherein secondary closure member is sufficiently thin to fit entirely within the confines of the recess in said main closure member whereby to move into said guide arrangement section with said main closure member when the latter moves to its second position.

9. An apparatus according to claim 8 wherein said seal establishing means includes seal means carried by said main closure member and said guide arrangement for providing seals between one another and between the guide arrangement and said containers.

10. An apparatus according to claim 9 wherein said secondary closure member includes seal means providing a seal between said secondary closure member and said second container when the secondary closure member is connected to the second container in said predetermined way.

* * * * *